US008161856B2

(12) United States Patent
Jacko et al.

(10) Patent No.: US 8,161,856 B2
(45) Date of Patent: Apr. 24, 2012

(54) APPARATUS FOR CUTTING FOOD PRODUCT

(75) Inventors: Michael S. Jacko, Chesterton, IN (US); Daniel Wade King, Valparaiso, IN (US); Rick Wendell Bajema, Plano, TX (US); Annette Stiers Jones, Dallas, TX (US); David Ray Warren, Plano, TX (US)

(73) Assignees: Urschel Laboratories, Inc., Valparaiso, IN (US); Frito-Lay North America, Inc., Plano, TX (US)

( * ) Notice: Subject to any disclaimer, the term of this patent is extended or adjusted under 35 U.S.C. 154(b) by 478 days.

(21) Appl. No.: 11/696,924

(22) Filed: Apr. 5, 2007

(65) Prior Publication Data

US 2007/0240550 A1 Oct. 18, 2007

Related U.S. Application Data

(60) Provisional application No. 60/745,028, filed on Apr. 18, 2006.

(51) Int. Cl.
*B26D 1/03* (2006.01)

(52) U.S. Cl. ..... 83/403; 83/932

(58) Field of Classification Search ..... 83/403, 83/932, 404, 407, 408, 658
See application file for complete search history.

(56) References Cited

U.S. PATENT DOCUMENTS

| | | | | |
|---|---|---|---|---|
| 2,712,904 | A * | 7/1955 | Durkee | 241/92 |
| 3,139,128 | A | 6/1964 | Urschel et al. | |
| 3,395,742 | A * | 8/1968 | Sanders | 83/698.41 |
| 4,700,600 | A * | 10/1987 | Pickett | 83/165 |
| 4,972,888 | A | 11/1990 | Dean | |
| 5,694,824 | A | 12/1997 | Jacko et al. | |
| 6,116,130 | A * | 9/2000 | Cogan | 83/403 |
| 6,968,765 | B2 | 11/2005 | King | |
| 7,178,440 | B2 * | 2/2007 | Bucks | 83/663 |
| 2005/0000344 | A1 | 1/2005 | Bucks | |
| 2005/0150345 | A1 | 7/2005 | Bucks | |

FOREIGN PATENT DOCUMENTS

DE 19518609 2/1996

* cited by examiner

*Primary Examiner* — Boyer D Ashley
*Assistant Examiner* — Omar Flores Sanchez
(74) *Attorney, Agent, or Firm* — Hartman & Hartman, P.C.; Gary M. Hartman; Domenica N. S. Hartman

(57) ABSTRACT

A cutting apparatus having an annular-shaped cutting head and an impeller assembly coaxially mounted for rotation within the cutting head to deliver food products radially outward toward the cutting head. The cutting head has at least one knife extending radially inward toward the impeller assembly. The knife has a cutting edge at a radially innermost extremity and a radially outer face that defines a trajectory plane for slices removed from the products by the cutting edge. The knife is clamped to the cutting head with a clamping feature that provides clearance for slices when traveling the trajectory plane of the knife.

11 Claims, 20 Drawing Sheets

APPARATUS FOR CUTTING FOOD PRODUCT

CROSS REFERENCE TO RELATED APPLICATIONS

This application claims the benefit of U.S. Provisional Application No. 60/745,028, filed Apr. 18, 2006, the contents of which are incorporated herein by reference.

BACKGROUND OF THE INVENTION

The present invention generally relates to cutting methods and equipment. More particularly, this invention relates to an apparatus equipped with an impeller assembly that positions and orients elongate food products prior to encountering a cutting device that produces size-reduced products of generally consistent thickness.

Various types of equipment are known for slicing, shredding and granulating food products such as vegetables, fruits, and meat products. A particular example is slicing equipment adapted for cutting root vegetables such as potatoes into thin slices suitable for making potato chips (also known as potato crisps). A widely used machine for this purpose is commercially available from Urschel Laboratories, Inc., under the name Urschel Model CC®. The Model CC® is a centrifugal-type slicer capable of producing uniform slices, strip cuts, shreds and granulations of a wide variety of food products at high production capacities. When used to produce potato slices for potato chips, the Model CC® can make use of substantially round potatoes to produce the desired circular chip shape with a minimum amount of scrap. Descriptions pertaining to the construction and operation of the Model CC®, including improved embodiments thereof, are contained in U.S. Pat. Nos. 5,694,824 and 6,968,765, the entire contents of which are incorporated herein by reference.

FIGS. 1 and 3 are perspective views of an impeller 10 and cutting head 12, respectively, of types that can be used in the Model CC® machine. In operation, the impeller 10 is coaxially mounted within the cutting head 12, which is generally annular-shaped with cutting knives 14 mounted on its perimeter. The impeller 10 rotates within the cutting head 12, which remains stationary. Each knife 14 projects radially inward toward the impeller 10 and in a direction generally opposite the direction of rotation of the impeller 10, and defines a cutting edge at its radially innermost extremity. The impeller 10 has generally radially-oriented paddles 16 with faces 34 that engage and direct food products (e.g., potatoes) 36 radially outward against the knives 14 of the cutting head 12 as the impeller 10 rotates. The paddles 16 are shown as oriented to have what is termed herein a negative pitch, which as viewed in FIG. 2 denotes that the face 34 of each paddle 16 has a radially innermost extent angled away from the direction of rotation of the impeller 10 relative to a radial 38 of the impeller 10 terminating at the radially outermost extent of the face 34. Such an orientation has been found to be preferred with the impeller 10 and cutting head 12 of FIGS. 1 through 3. The impeller 10 is typically formed as a casting, such as from a manganese aluminum bronze (MAB) alloy, and therefore has a unitary construction.

The cutting head 12 shown in FIG. 3 comprises a lower support ring 18, an upper mounting ring 20, and circumferentially-spaced support segments 22. The knives 14 of the cutting head 12 are individually secured with clamping assemblies 26 to the support segments 22, which are pivotally attached to the support and mounting rings 18 and 20, such as with one or more coaxial pins (not shown) that engage holes in the support and/or mounting rings 18 and 20. By pivoting on the pins, the orientation of a support segment 22 can be adjusted to alter the radial location of the cutting edge of its knife 14 with respect to the axis of the cutting head 12, thereby controlling the thickness of the sliced food product. As an example, adjustment can be achieved with an adjusting screw and/or pin 24 located circumferentially behind the pivot pins. FIG. 3 further shows gate insert strips 23 mounted to each support segment 22 immediately downstream of each knife 14. The gate insert strips 23 do not cover the entire axial extent of the cutting head 12, but instead define an opening 25 at each of their lower ends through which rocks and other debris that settle by gravity toward the bottom of the impeller 10 can feed through the cutting head 12 without damaging the knives 14.

The knives 14 can be attached to their respective support segments with bolts, clamping assemblies, etc. FIGS. 9 and 10 are cross-sectional views through a portion of the cutting head 12 looking toward the lower support ring 18. FIG. 9 shows a knife 14 held in place with a clamping assembly 26 comprising inner and outer holders 27 and 28 secured with bolts 29 to a support segment 22, generally as described in U.S. Pat. No. 6,968,765 and particularly in reference to FIG. 7 of this prior patent. FIG. 10 shows a knife 14 encased in a plastic cartridge 30, which helps to protect the knife 14 from damage by rocks and other debris that may be embedded in or otherwise present with the food products being fed through the impeller 10. The knife 14 and its plastic cartridge 30 are held in place between a pair of holders 27 and 28, with the radially outer holder 28 being forcibly held in place on the support segment 22 with a clamping rod 32. The clamping rod 32 is shown oriented perpendicular to the support and mounting rings 18 and 20, and secured to the radially inner holder 27 with a fastener 31. Rotating a lever 33 creates a camming action that forces the outer holder 28 outward against the rod 32, and forcing the outer holder 28 against the knife 14. In each case, the knives 14 are disposable and must be replaced to maintain the cutting efficiency of the cutting head 12 and the quality of the sliced food product. The cutting edge 15 of each knife 14 is shown in FIGS. 9 and 10 as being formed to have a double bevel. As evident from FIG. 9, the trajectory 35 of slices produced at the knife edge 15 is free of any obstacles downstream and radially outward from a plane defined by the outer surface of the outer holder 28. In FIG. 10, the plastic cartridge 30 deflects slices away from the clamping rod 32.

While the Model CC® has performed extremely well for its intended purpose, further improvements are continuously desired and sought for slicing machines of the type represented by the Model CC®. For example, knives with double bevels as shown in FIGS. 9 and 10 tend to compress food product during slicing. In the case of slices cut from potatoes and cooked in oil to produce potato chips, compression during slicing can be sufficient to cause starch loss, which undesirably promotes oil absorption during cooking. While single-bevel knives reduce compression, they reduce the trajectory angle to the extent that the slices tend to impact the clamping rod 32 downstream. Though the plastic cartridge 30 avoids this by deflecting slices away from the clamping rod 32, the compressibility of the plastic material reduces the precision with which the cutting edges 15 of the knives 14 can be located, making production of slices with consistent thicknesses difficult. Other variables that can affect the operation of the Model CC® slicing machine and/or reduce the consistency of slices include the presence of contaminants such as stones embedded or mixed in with the products, which can damage the cutting edges of the knives, and the use of small products that tend to roll within the impeller 10.

BRIEF SUMMARY OF THE INVENTION

The present invention provides a cutting apparatus having an annular-shaped cutting head and an impeller assembly coaxially mounted for rotation within the cutting head. The impeller assembly rotates about an axis of the cutting head in a rotational direction relative to the cutting head to deliver round food products radially outward toward the cutting head. The cutting head has at least one knife extending radially inward toward the impeller assembly in a direction opposite the rotational direction of the impeller assembly. The knife has a cutting edge at a radially innermost extremity thereof and a radially outer face that defines a trajectory plane for slices removed from the food products by the cutting edge.

According to one aspect of the invention, the knife is clamped to the cutting head with a clamping feature that includes a clamping bar with which the clamping feature generates a clamping force to secures the knife to the cutting head. The clamping bar is located adjacent a radially outermost extremity of the knife, oriented substantially parallel to the knife, and has a thickness in a radial direction of the cutting head that decreases in a direction toward the knife to provide clearance for the slices when traveling the trajectory plane of the knife. A significant advantage of this aspect of the invention is that slices of food product can be ejected from the cutting head without striking any structure downstream, and without resorting to the use of a double-beveled knife or sheathing the knife in a plastic cartridge. As such, the knife can have a single-bevel cutting edge to minimize compression of the product, and the cutting edge of the knife can be located with greater precision to produce slices with more consistent thicknesses.

The impeller assembly is preferably equipped with paddles to deliver the food products radially outward toward the cutting head. According to another aspect of the invention, each paddle has a radially outer extremity adjacent a periphery of the impeller assembly, an oppositely-disposed radially inner extremity, and a face between the radially inner and outer extremities and facing the rotational direction of the impeller assembly. Each paddle has grooves parallel to the radially outer extremity thereof. According to yet another aspect of the invention, each paddle has a plurality of removable posts mounted to its radially outer extremity and extending in a radially outward direction of the impeller assembly. A significant advantage achieved with the grooved paddles is to discourage smaller food products from rolling within the impeller. A significant advantage achieved with the removable posts is to avoid stones and other contaminants mixed with the product from being forced into and damaging the knife cutting edge.

Other objects and advantages of this invention will be better appreciated from the following detailed description.

DETAILED DESCRIPTION OF THE INVENTION

Figure 3:
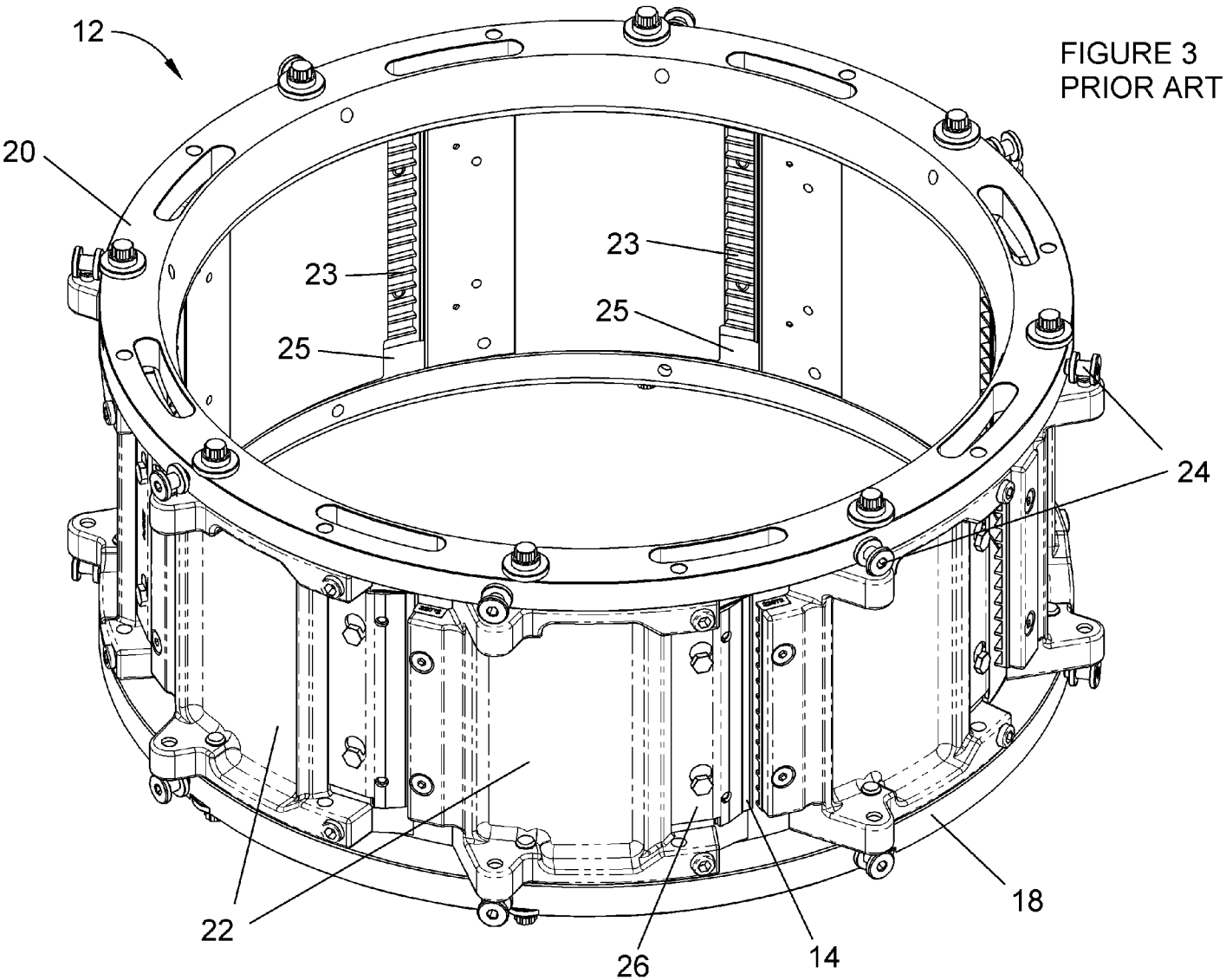
FIGURE 3 PRIOR ART
FIG. 3 is a perspective view of an existing cutting head for the Model CC® slicer.
Figure 4A:
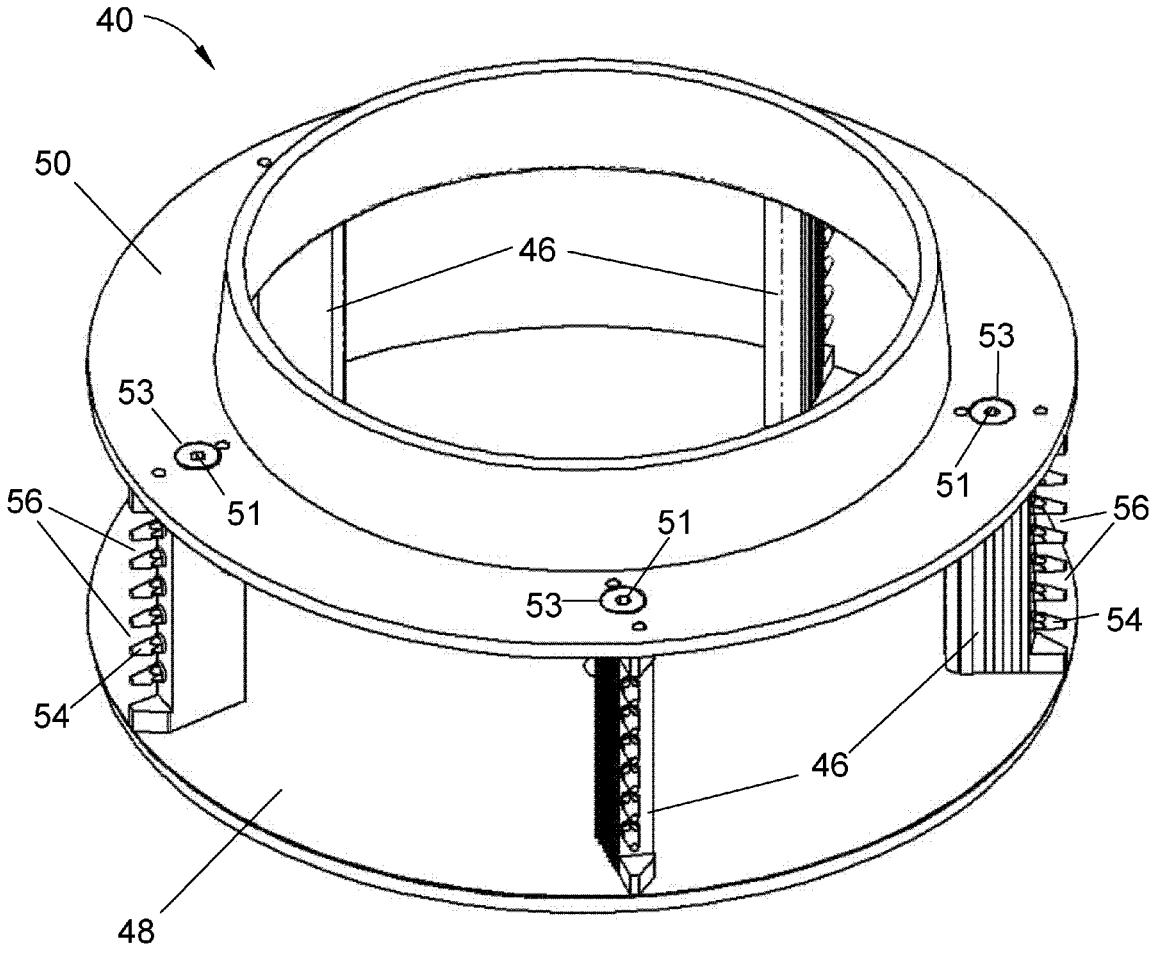
FIGS. 4A, 4B, and 4C are perspective, side, and cross-sectional views, respectively, of an impeller assembly suitable for use with the Model CC® slicer in accordance with a preferred embodiment of the invention.
Figure 4B:
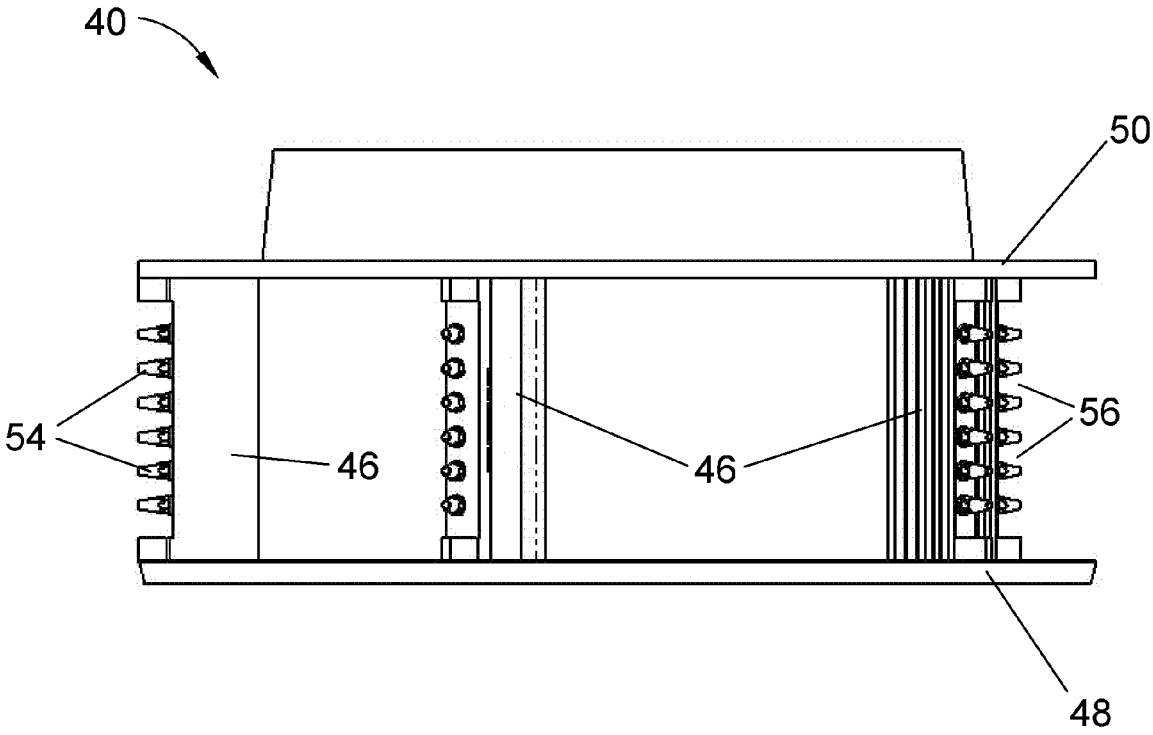
Figure 4C:
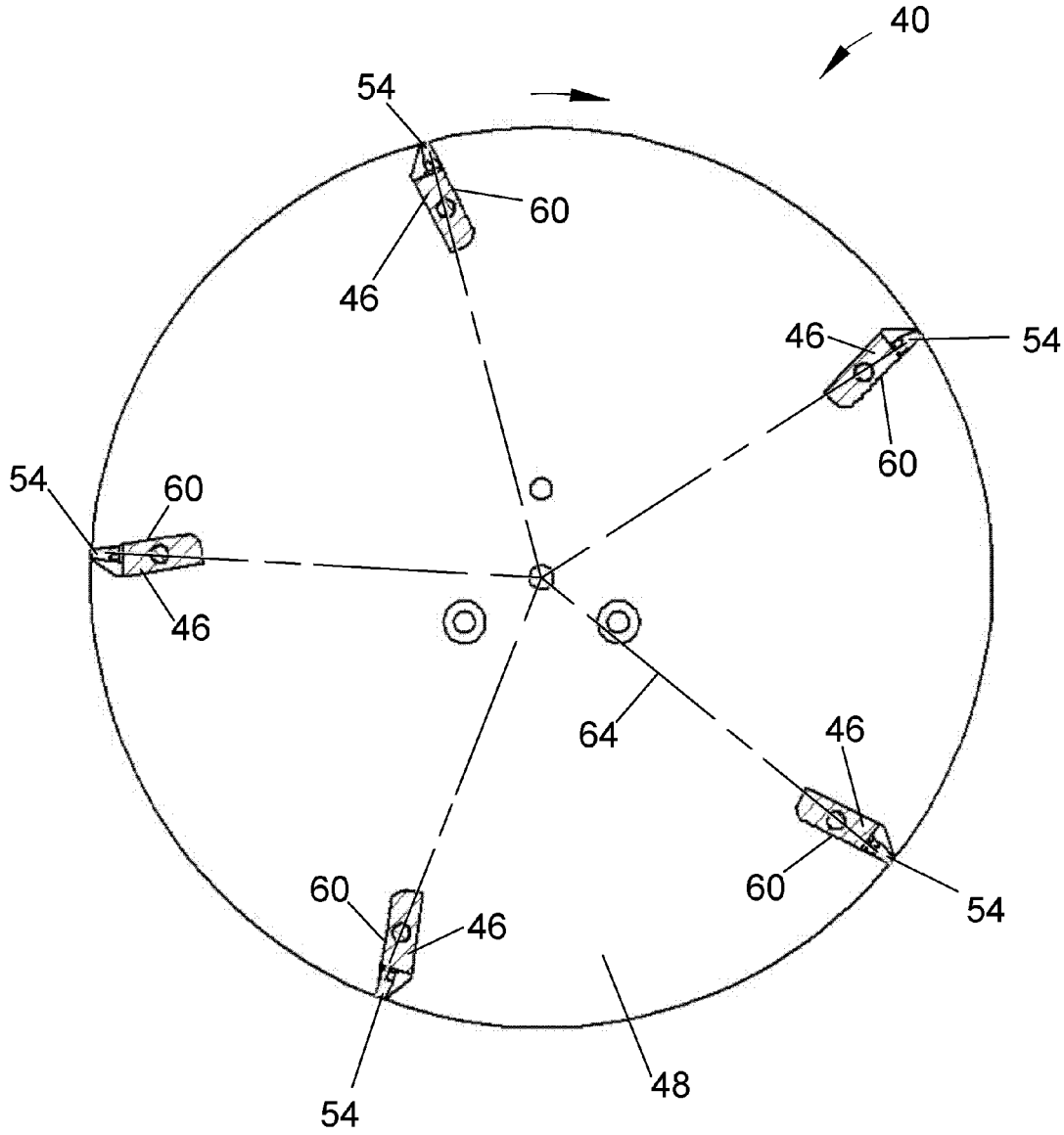
Figure 5:
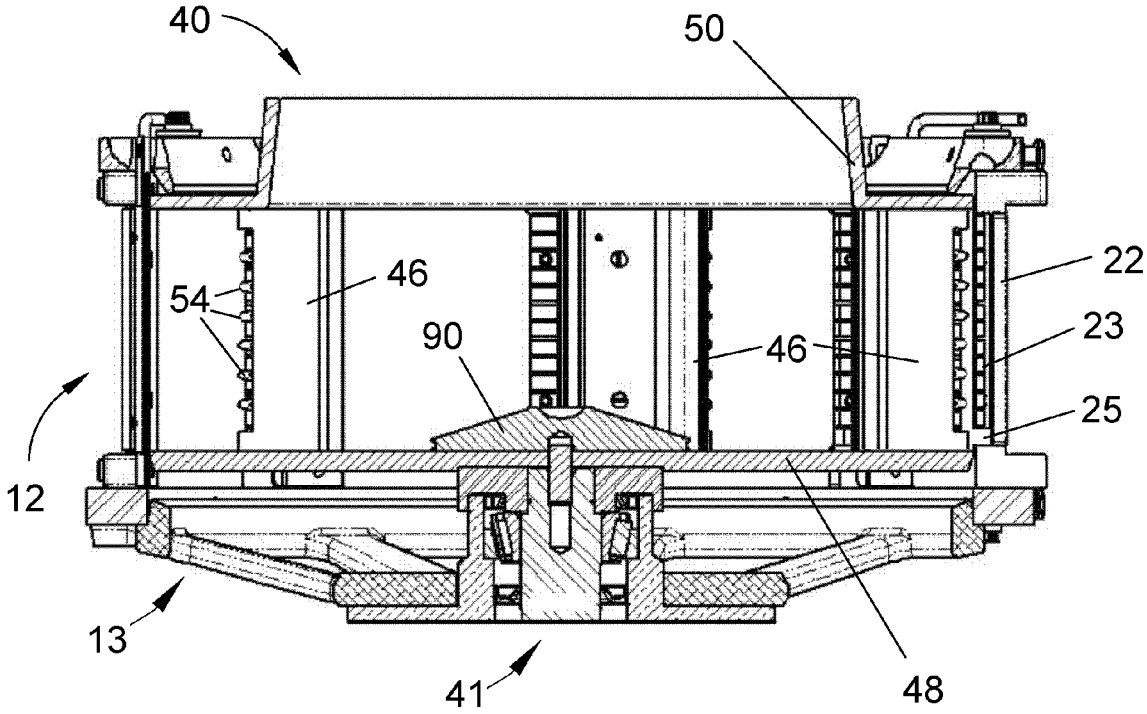
FIG. 5 is a cross-sectional view of the impeller assembly of FIGS. 4A, 4B, and 4C assembled with the deflector of FIG. 4D and mounted within the cutting head of FIG. 3.

FIGS. 4A, 4B, and 4C show a modified impeller assembly 40 in accordance with the present invention. As depicted in FIG. 5, the impeller assembly 40 is configured for rotation within cutting heads similar to the cutting head 12 of FIG. 3, as well as cutting heads 42 configured in accordance with FIGS. 11 through 13.

Figure 1:
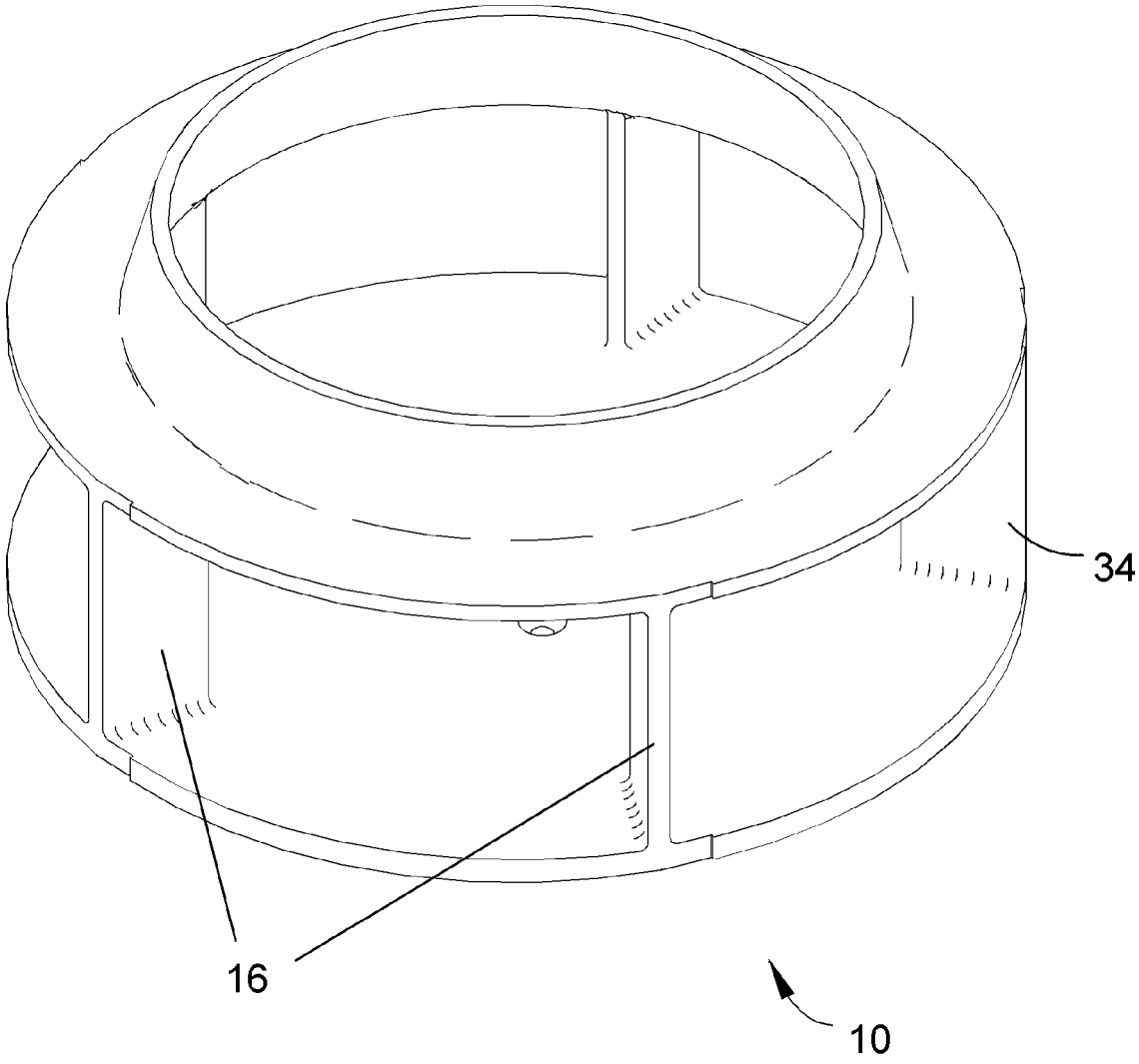
FIGURE 1 PRIOR ART
FIGS. 1 and 2 are perspective and cross-sectional views, respectively, of an existing impeller for the Model CC® slicer.
Figure 2:
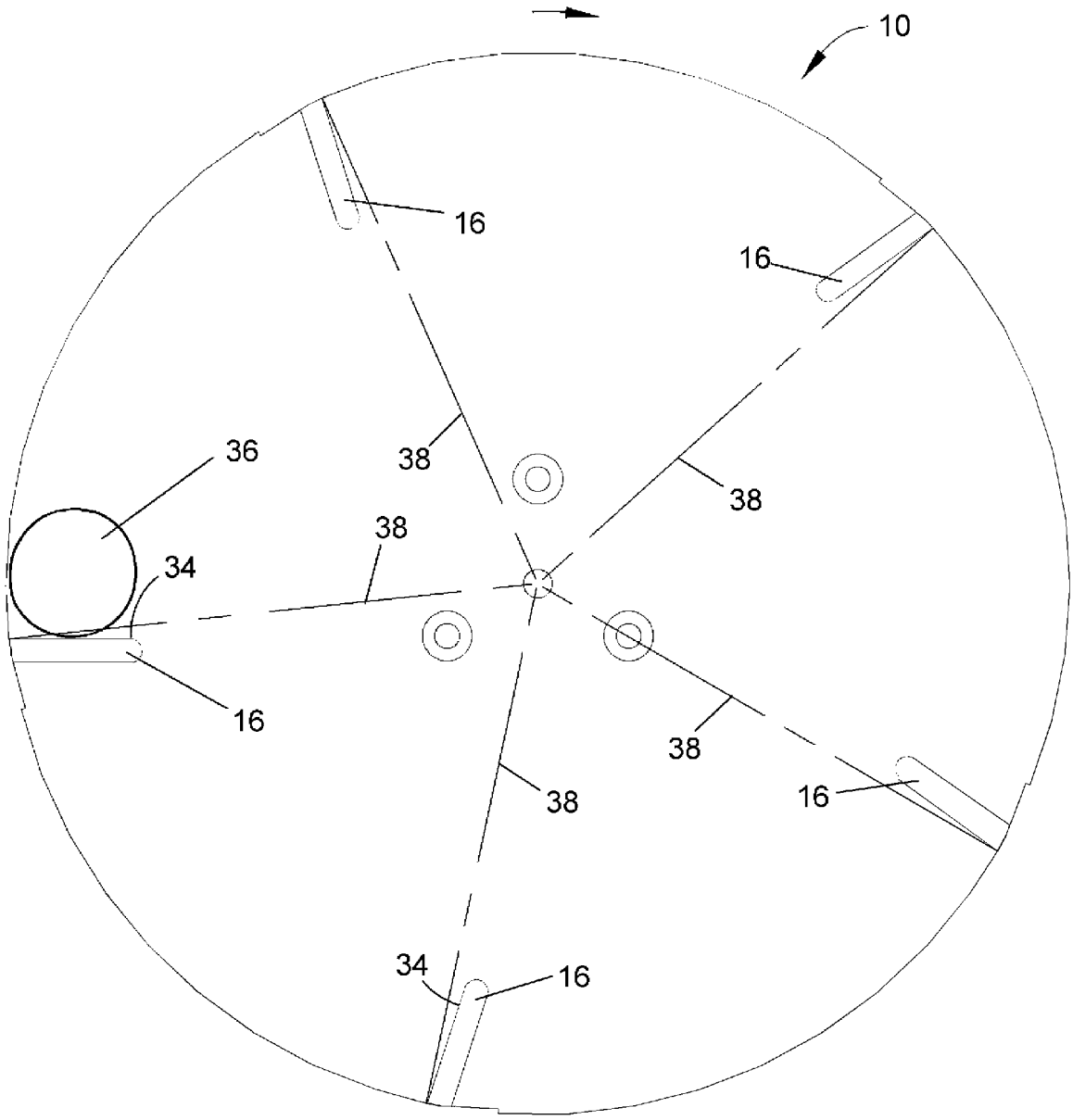
FIGURE 2 PRIOR ART

Similar to the impeller 10 of FIGS. 1 and 2, the impeller assembly 40 has generally radially-oriented paddles 46 with faces 60 that engage and direct food products (e.g., potatoes) radially outward against knives of the cutting head as the impeller assembly 40 rotates. However, as evident from FIGS. 4A, 4B, and 4C, the paddles 46 are significantly different in construction and configuration from the prior art paddles 16 of FIGS. 1 and 2. Because of the configuration of the paddles 46, the impeller assembly 40 is preferably constructed of individually formed paddles 46 mounted and secured between a pair of annular-shaped plates 48 and 50. As a result of its modular construction, the impeller 40 and its components can be formed by processes other than casting, and formed of various materials in addition to commonly-used MAB alloys.

Each of the paddles 46 is shown in FIG. 4A as being individually mounted with bolts 51 and pins 52 to a corresponding set of mounting holes 53 machined in the plates 48 and 50. The placement of the mounting holes 53 determines the orientation or pitch of each paddle face 60 relative to a radial 64 of the impeller assembly 40 terminating at the radially outermost extent of the paddle face 60. The pitch of the paddle faces 60 can be negative (such as the orientation seen in FIG. 2), neutral (meaning that the face 60 of each paddle 46 lies in the radial 64 of the impeller assembly 40), or positive (such as the orientation seen in FIG. 4C, in which the radially innermost extent 66 of each paddle face 60 is angled toward the direction of rotation of the impeller assembly 40 relative to the radial 64). A single set of holes 53 is provided for each paddle 46 so that the paddles 46 for a given impeller assembly 40 are limited to having a negative, neutral, or positive pitch, as may be desired. In an alternative embodiment shown in FIGS. 4E, 4F, and 4G, multiple sets of mounting holes 53 are provided in the plates 48 and 50 to enable reorientation of the pitch of each paddle 46 on the impeller assembly 40.

Figure 6A:
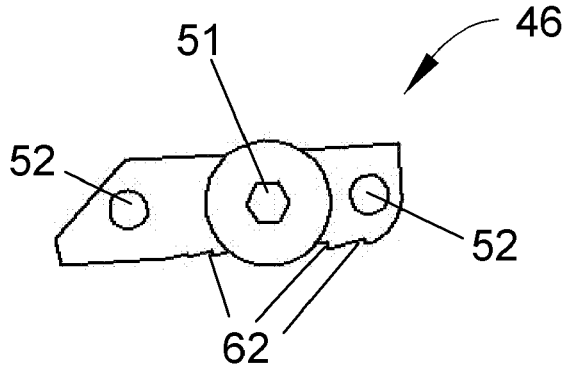
FIGS. 6A and 6B are isolated top and side views, respectively, of an impeller paddle of the impeller assembly of FIGS. 4A, 4B, and 4C.
Figure 6B:
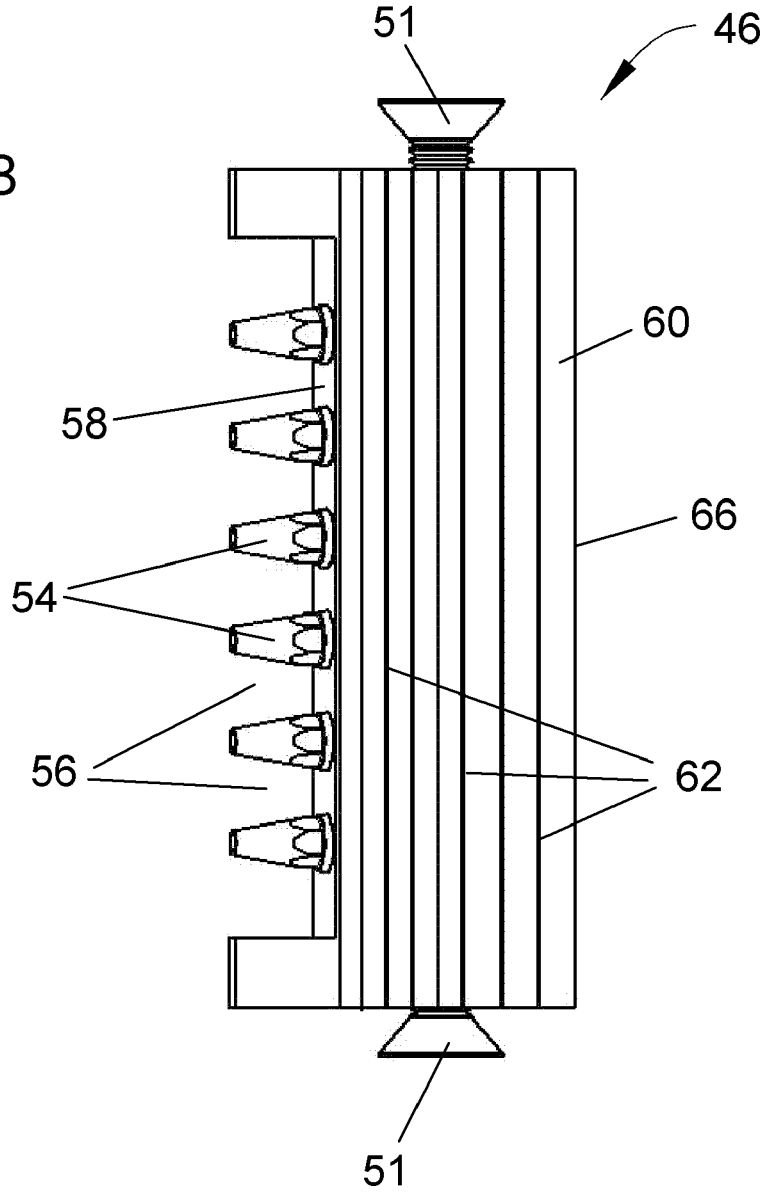
Figure 7:
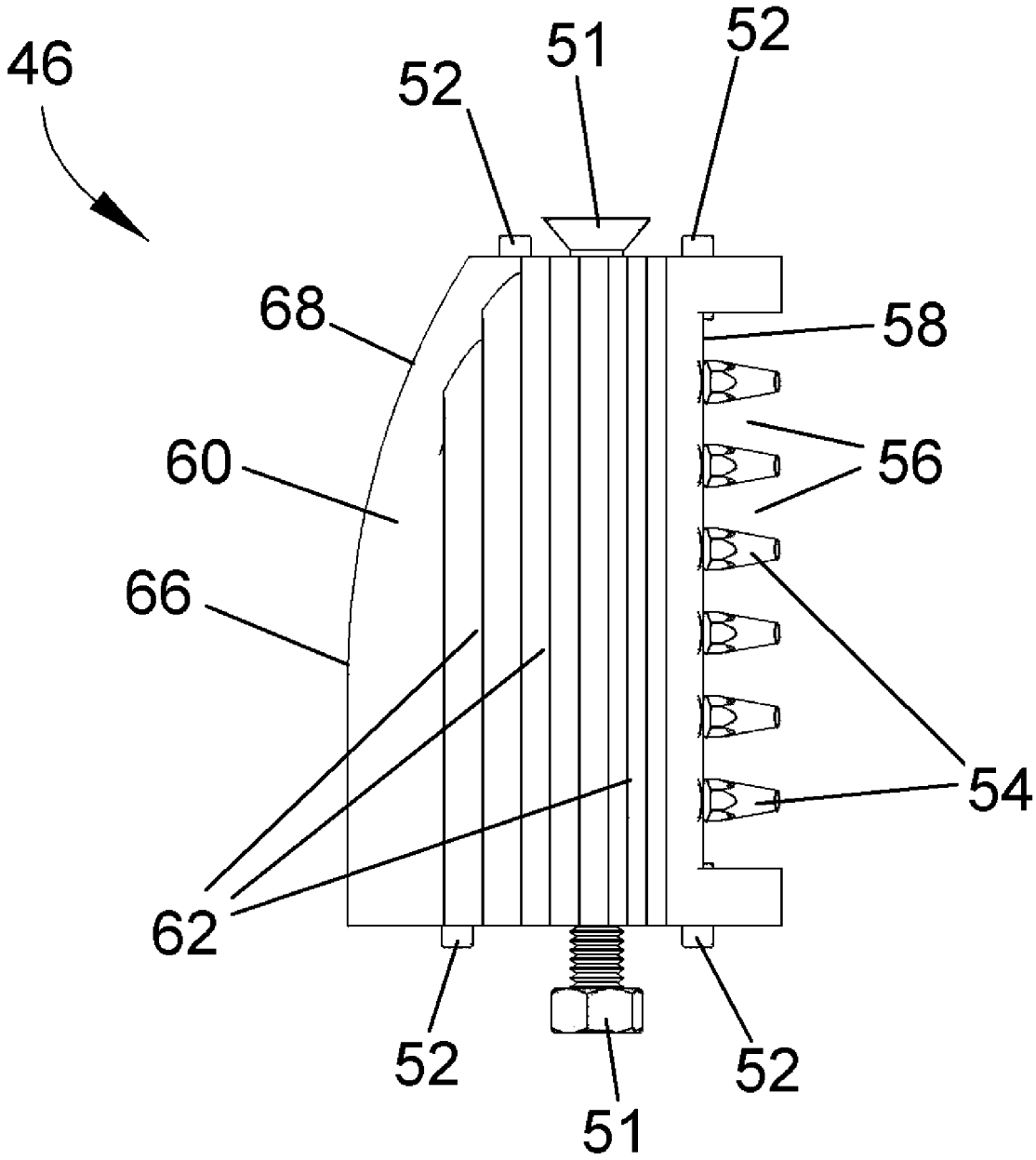
FIG. 7 is an isolated side view of an impeller paddle of the impeller assembly of FIGS. 4E, 4F, and 4G.

FIGS. 6A and 6B show an individual paddle 46, which can be seen as symmetric in the axial direction of the impeller assembly 40 (from top to bottom in FIGS. 4A and 4B). The radially innermost extent 66 of each paddle 46 is generally straight and axially-oriented. Suitable dimensions for the paddle 46 will depend in part on the size of the food products being processed, and therefore can vary considerably. For accommodating food products with diameters up to about four inches (about ten centimeters), a suitable radial width for each paddle 46 is up to about two inches, as measured from the radially outermost extent of the paddle face 60 to a line at the intersection of the paddle face 60 and a radius defining the radially innermost extent 66 of the paddle 46. FIG. 7 shows an individual paddle 46 of the alternative embodiment of FIGS. 4E, 4F, and 4G. The alternative paddle 46 of FIG. 7 is asymmetric in the axial direction of the impeller assembly 40 (from top to bottom in FIGS. 4E and 4F), in contrast to the paddles 16 of FIGS. 4A through 4C, 6A, and 6B. The radially innermost extent 66 of each alternative paddle 46 is generally straight and axially-oriented adjacent the lower plate 48, but with a boundary 68 adjacent the upper plate 50 that curves radially outward as it approaches the upper plate 50. Though not required, this shape and contour for the innermost extent of each paddle 46 has the desirable effect of reducing damage to food products being processed.

The Figures depict the paddles 46 as being equipped with multiple posts 54 located and spaced along their radially outermost extent, forming multiple gaps 56 through which rocks and other debris can pass and exit the impeller assembly 40 and subsequently the cutting head without damaging the paddles 46 of the impeller assembly 40 or the knives of the cutting head. The posts 54 are preferably replaceable, such as by threading into a face 58 machined into the radially outermost extent of each paddle 46. The posts 54 have generally conical shapes, and are preferably angled so that a profile of its conical shape is coplanar with the face 60 of its paddle 46, as seen in FIG. 6. As most readily evident from FIGS. 4, 5, and 7, the face 60 of each paddle 46 has axially-oriented grooves 62 to inhibit food product from rotating while engaged by the paddle 46. The distances between adjacent grooves 62 is shown as decreasing in the direction toward the outside diameter of the impeller assembly 40, since smaller food products (such as potatoes two inches (about five centimeters) and smaller) are usually rounder in shape and have less mass, and are therefore more likely to roll while they are engaged by a paddle 46. It is believed that, in combination, the grooves 62 on impeller paddles 46 having a positive pitch provide an optimal anti-rolling effect when small potatoes are being fed through the impeller assembly 40.

Figure 4D:
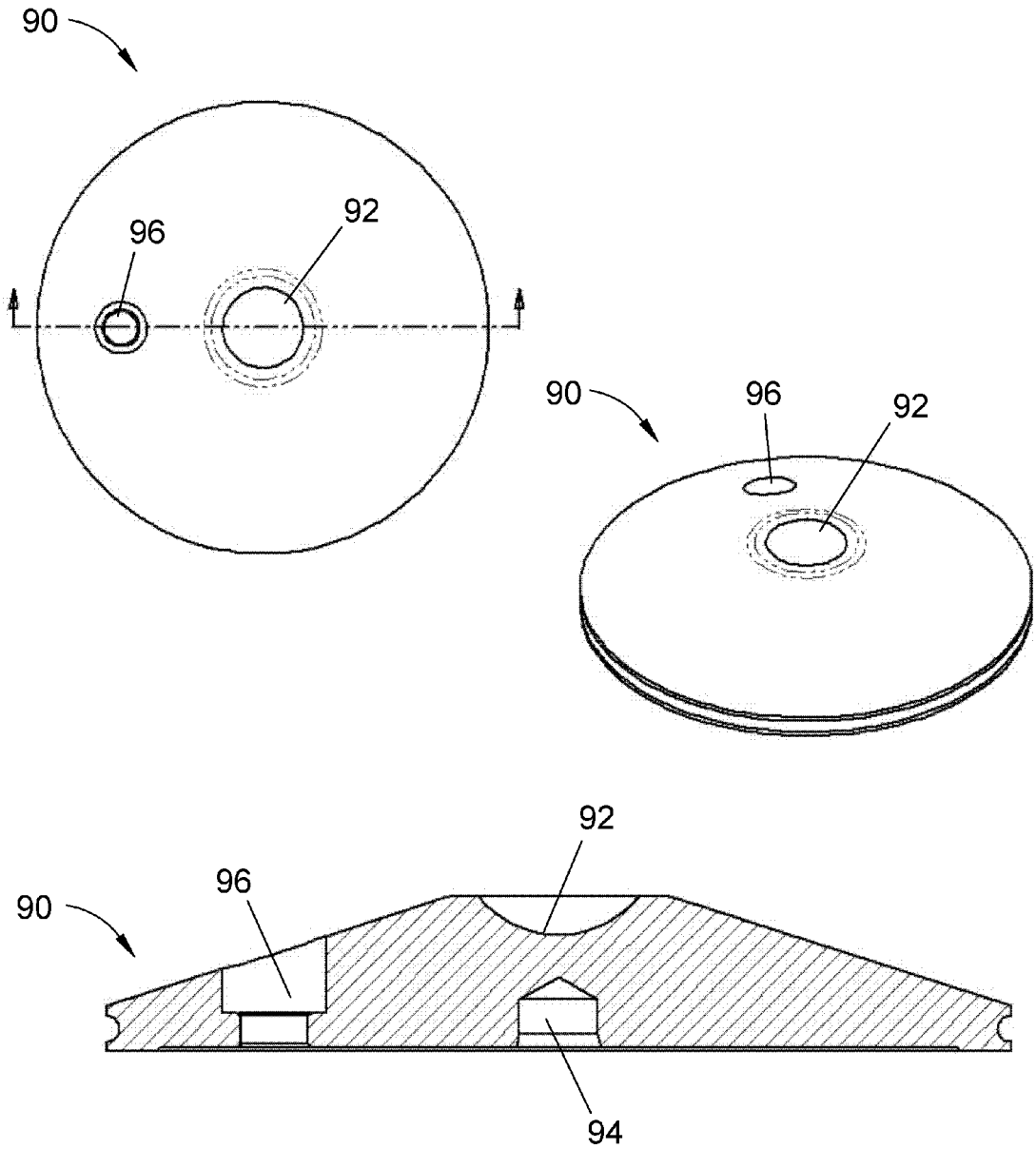
FIG. 4D shows plan, perspective, and cross-sectional views of a deflector for use with the impeller assembly of FIGS. 4A and 4B in accordance with an optional aspect of the invention.

FIG. 4D represents a deflector 90 for use with either of the impeller assemblies 40 of this invention. The deflector 90 is tapered to generally have an inverted cone-shape to direct food products radially outward toward the impeller paddles 46. The deflector 90 is further formed to have a central semi-spherical depression or recess 92. The function of the recess 92 is to cause water (or another lubricating fluid commonly used in food processing) originally directed downward toward the recess 92 to be redirected radially outward toward the upper ends of the paddles 46, and thereafter cascade down the vertical surfaces of the paddles 46 to provide a lubricating and cleaning effect. The deflector 90 has a central bore 94 for centrally locating the deflector 90 on the lower plate 48 of the impeller assembly 40 as shown in FIG. 5, and a countersunk bore 96 for receiving a bolt (not shown) to secure the deflector 90 to the lower plate 48.

FIG. 5 schematically represents the impeller assembly 40 of FIGS. 4A through 4C equipped with the deflector 90 of FIG. 4D and coaxially and concentrically mounted for rotation within the cutting head 12 of FIG. 3. The cutting head 12 is supported on a stationary frame 13, while the impeller assembly 40 is coupled to a drive shaft 41. The righthand side of FIG. 5 is a cross-section of gate insert strip 23 mounted to a support segment 22 immediately adjacent a knife (not shown), and shows the gate insert strip 23 as not covering the entire axial extent of the paddles 46. Instead, the gate insert strip 23 defines an opening 25 at its lower end through which rocks and other debris that settle by gravity toward the bottom of the impeller assembly 40 can feed through the cutting head 12 without damaging the knife.

Figure 4E:
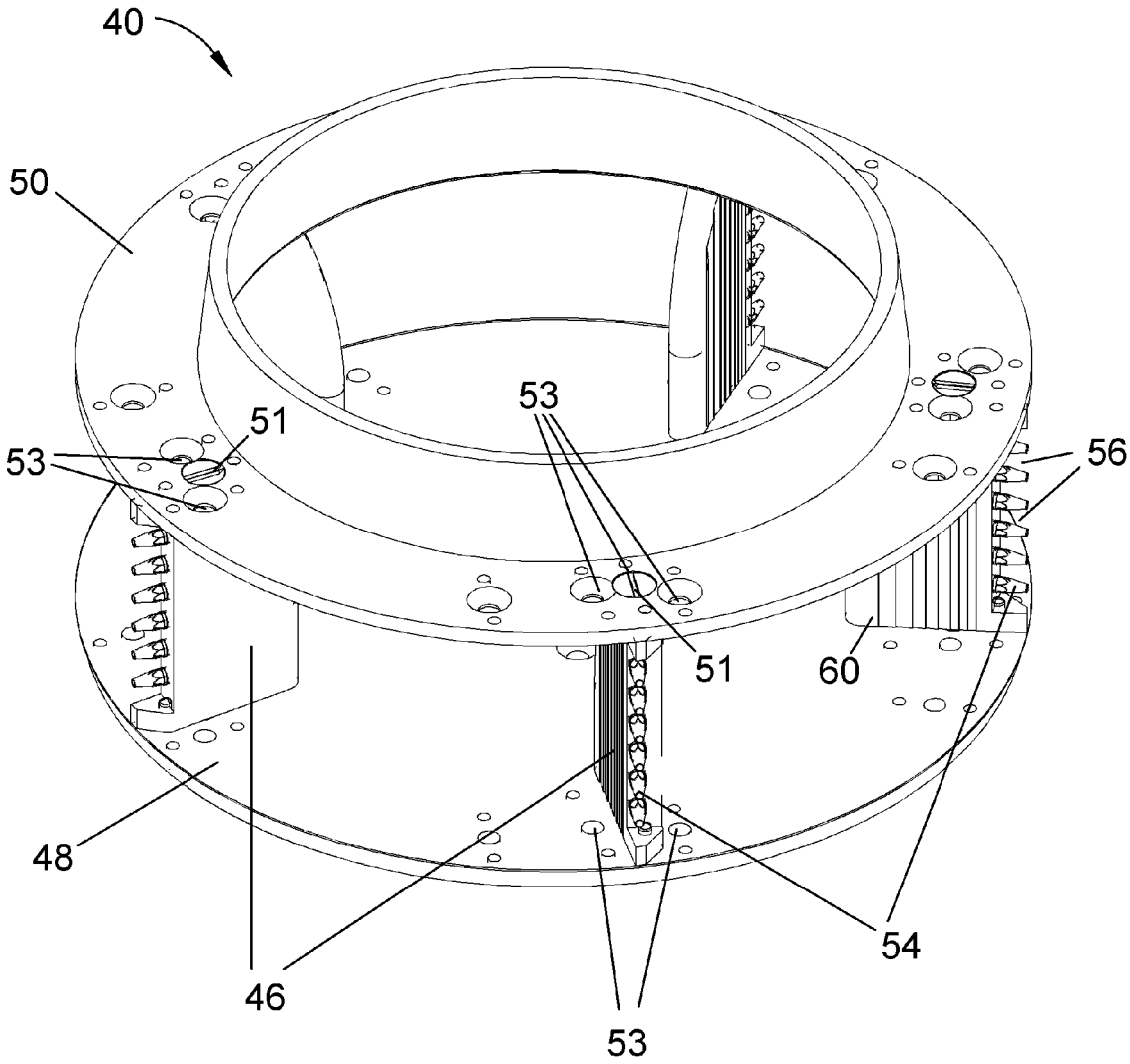
FIGS. 4E, 4F, and 4G are perspective, side, and cross-sectional views, respectively, of an impeller assembly suitable for use with the Model CC® slicer in accordance with an alternative embodiment of the invention.
Figure 4F:
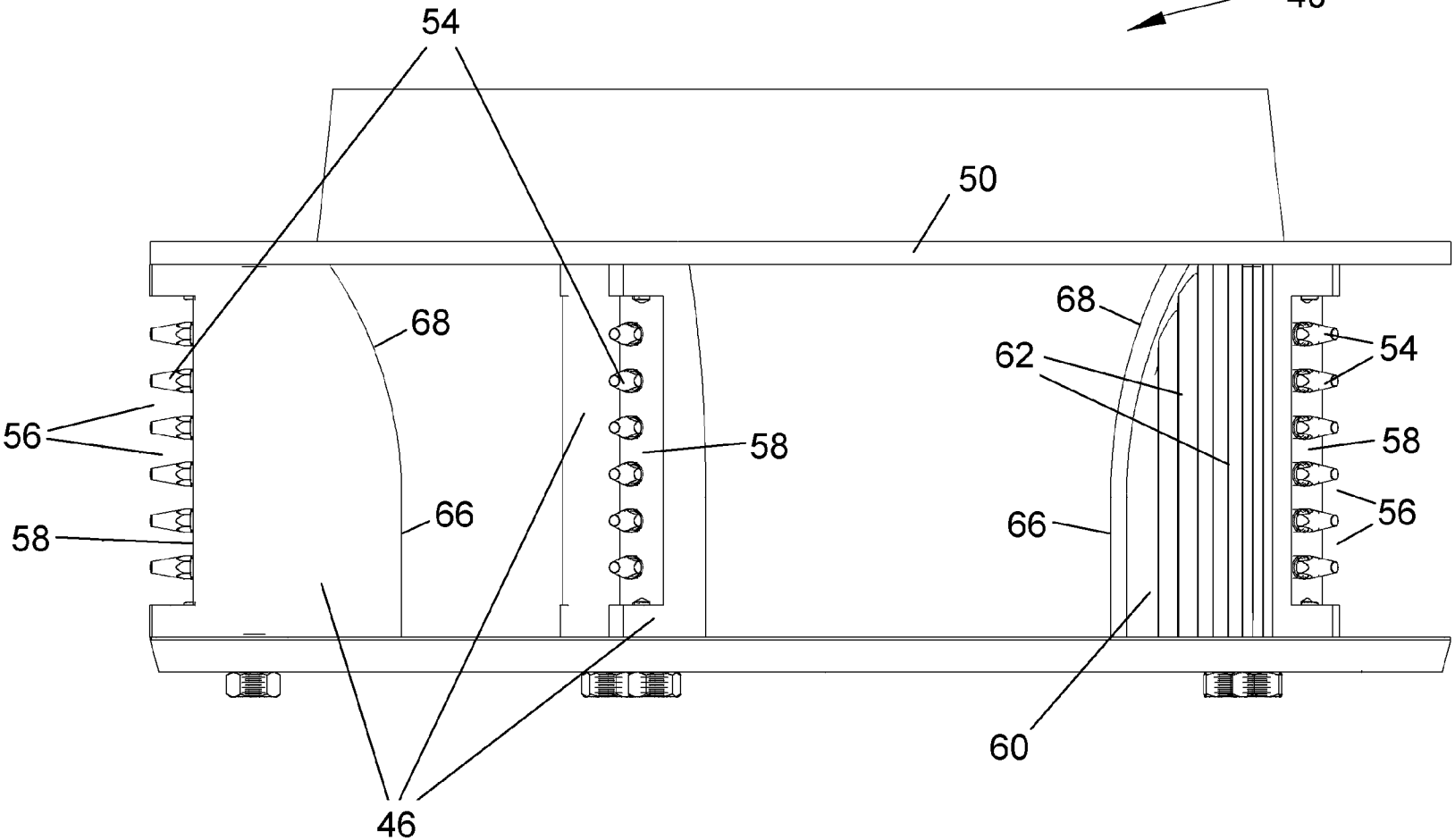
Figure 4G:
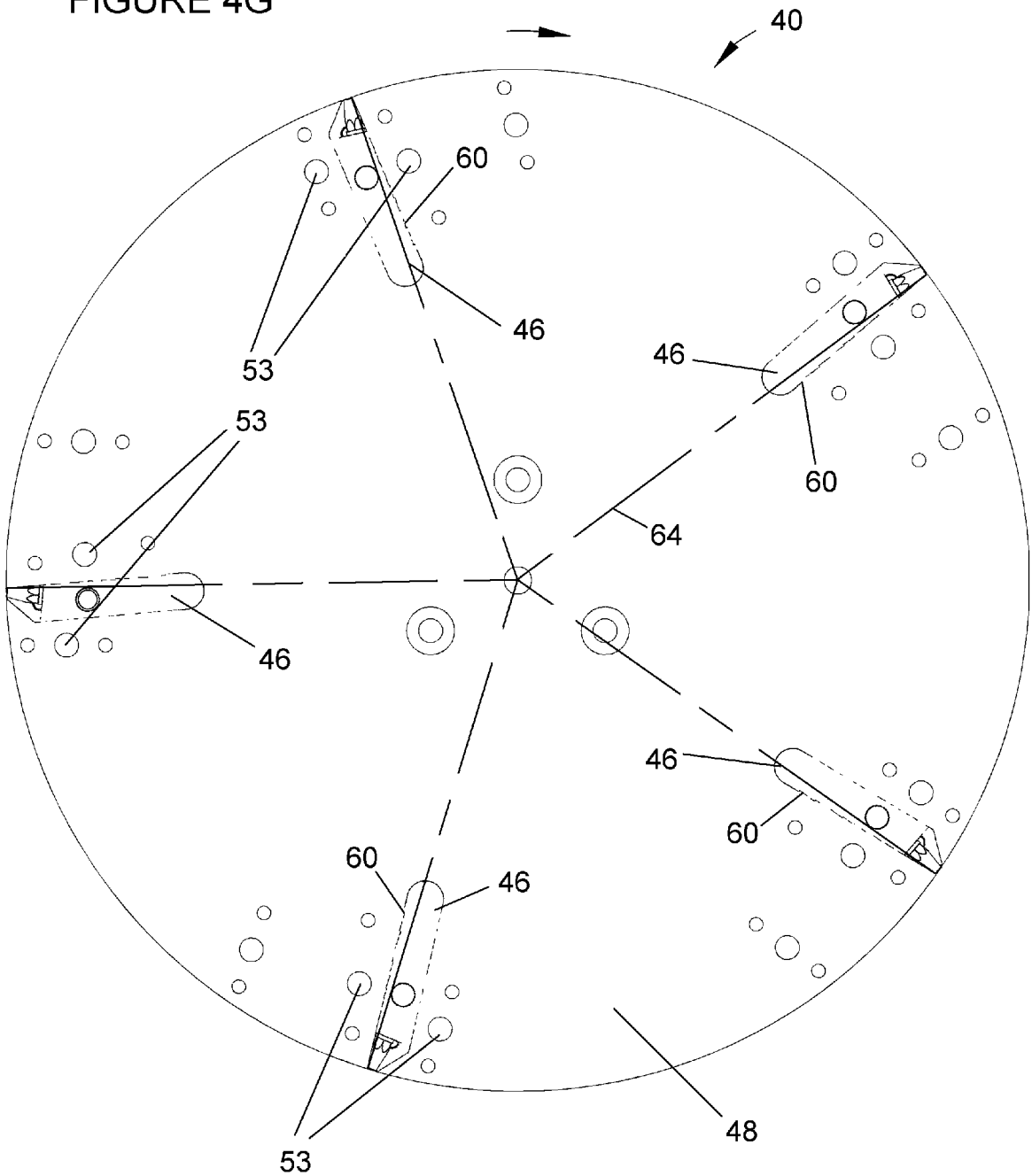
Figure 8:
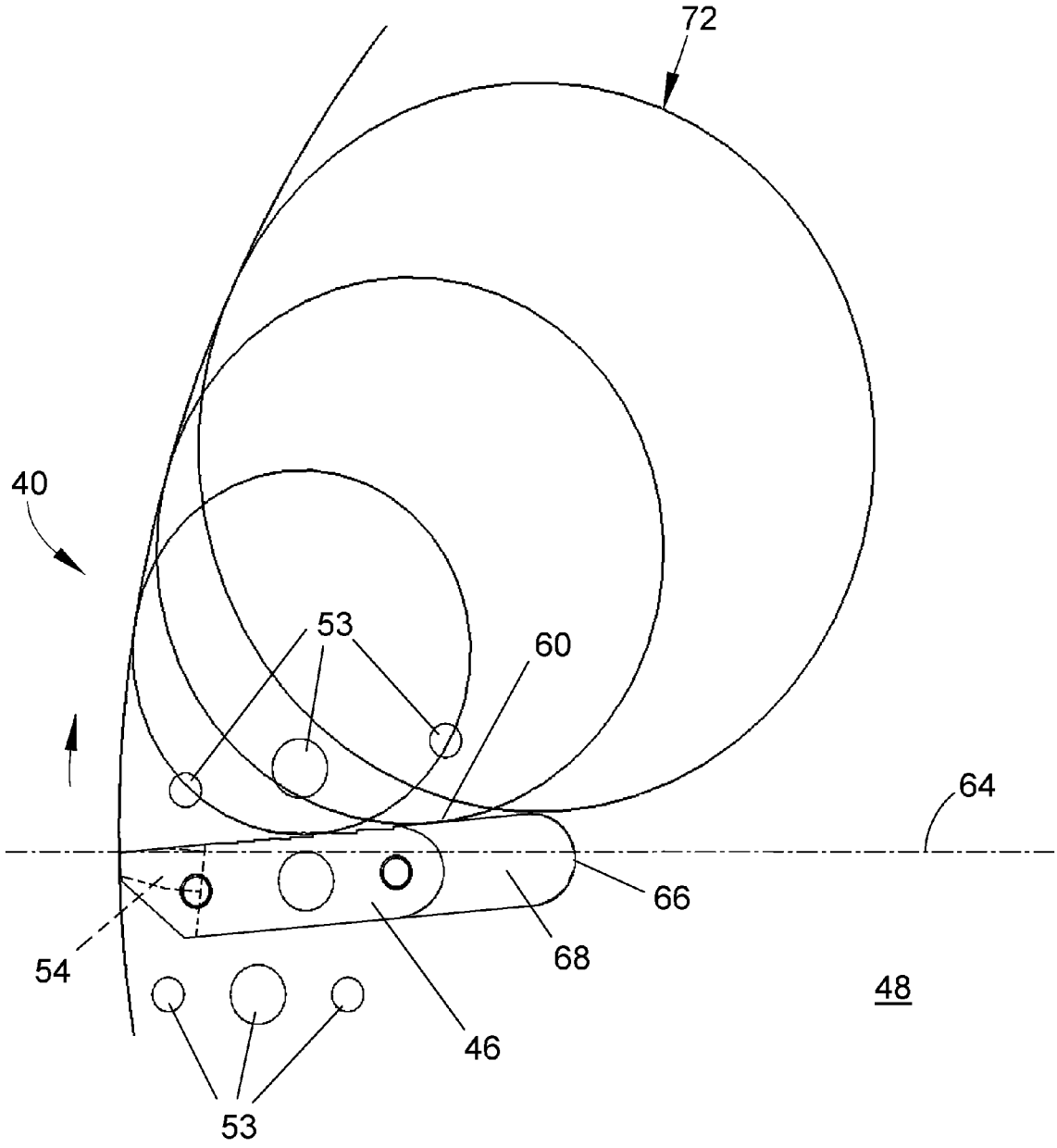
FIG. 8 is a cross-sectional view of an edge portion of the impeller assembly of FIGS. 4A, 4B, and 4C, schematically showing a single impeller paddle engaged with food products of various sizes.

FIG. 8 schematically represents a plan view of the impeller assembly 40 of FIGS. 4E through 4G, with the upper plate 50 removed and round potatoes 72 of different diameters engaged with one of its paddles 46. From FIG. 8, it can be seen that a four-inch diameter potato is tangent to the face 60 of the paddle 46 at a point on the intersection of the face 60 with a radius of the straight inner boundary 66 of the paddle 46, evidencing that the paddle 46 is sized to accommodate food products with diameters up to four inches (about 10 cm). The paddle 46 is shown in FIG. 8 as having a positive pitch of about five degrees. If the paddle 46 were mounted to the next set of mounting holes 53 above the paddle 46 (as viewed in FIG. 8), the paddle 46 would be angled an additional five degrees, providing a positive ten-degree pitch. If the paddle 46 were mounted to the next set of mounting holes 53 below the paddle 46 (as viewed in FIG. 8), the paddle 46 would have a neutral pitch.

Figure 10:
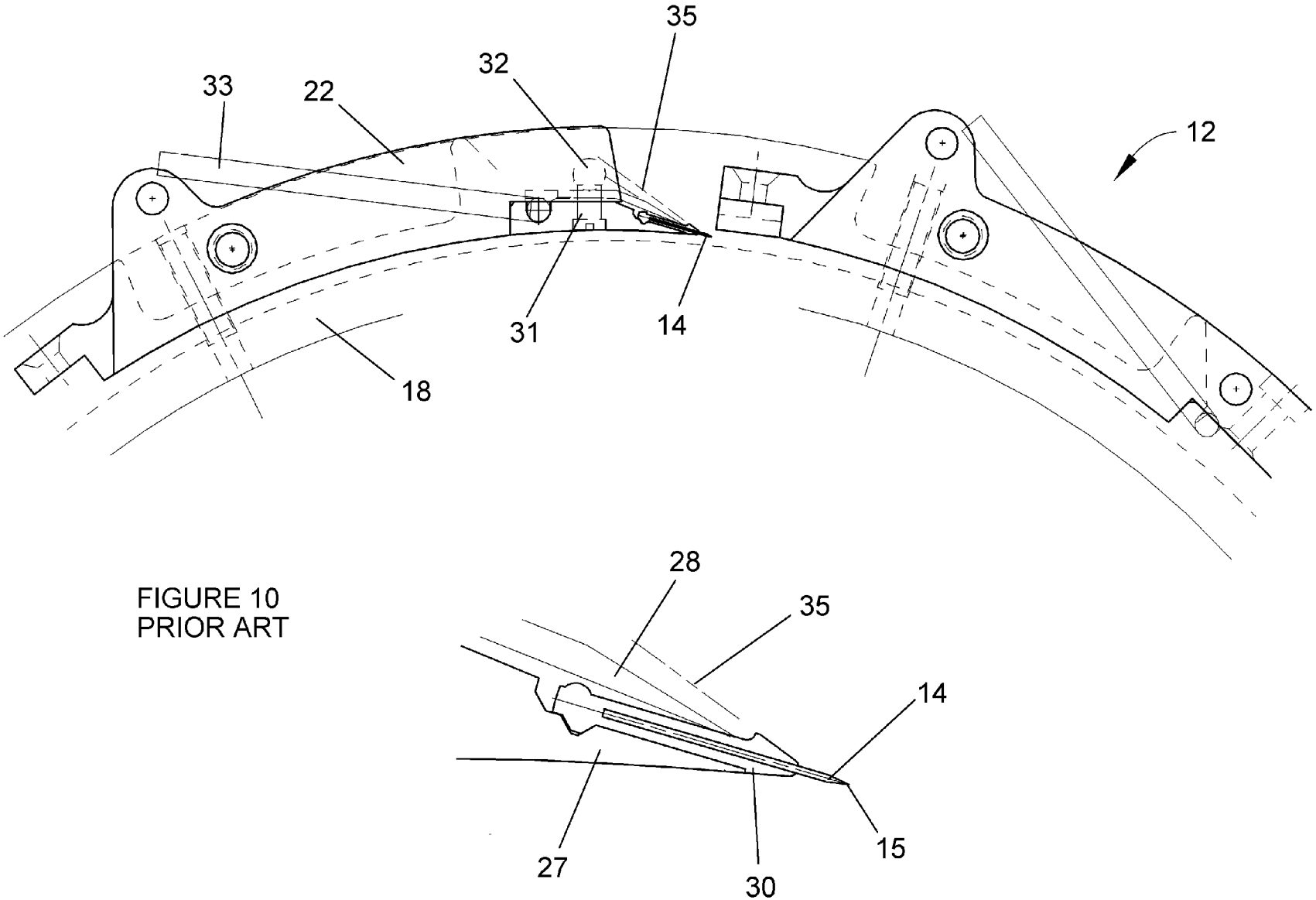
FIGURE 10 PRIOR ART
Figure 11:
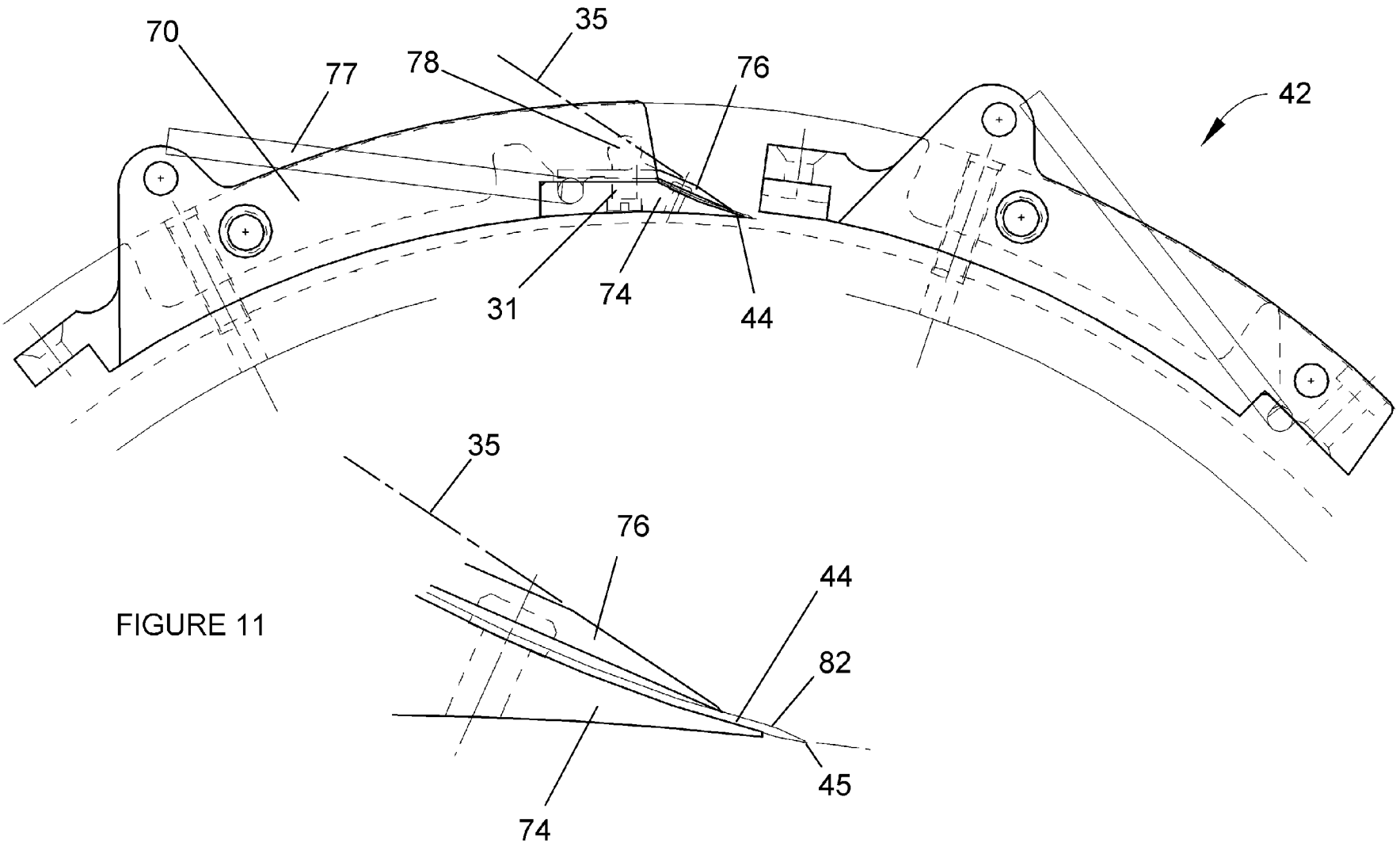
FIGS. 11, 12, and 13 are cross-sectional views showing portions of modified cutting heads suitable for use with the Model CC® slicer, and particularly the impeller assembly of FIGS. 4A, 4B, and 4C, in accordance with different embodiments of the invention.
Figure 12:
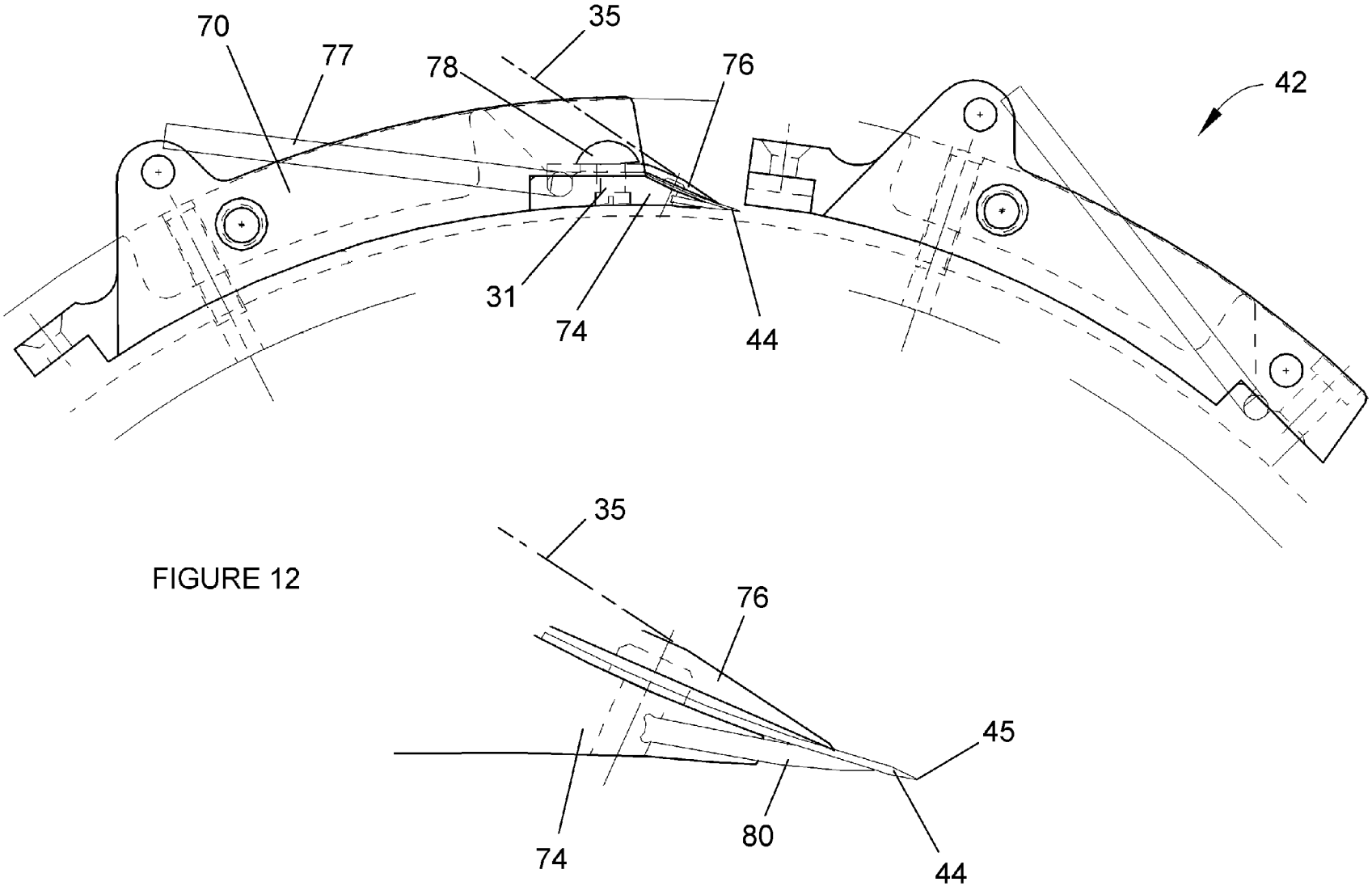
Figure 13:
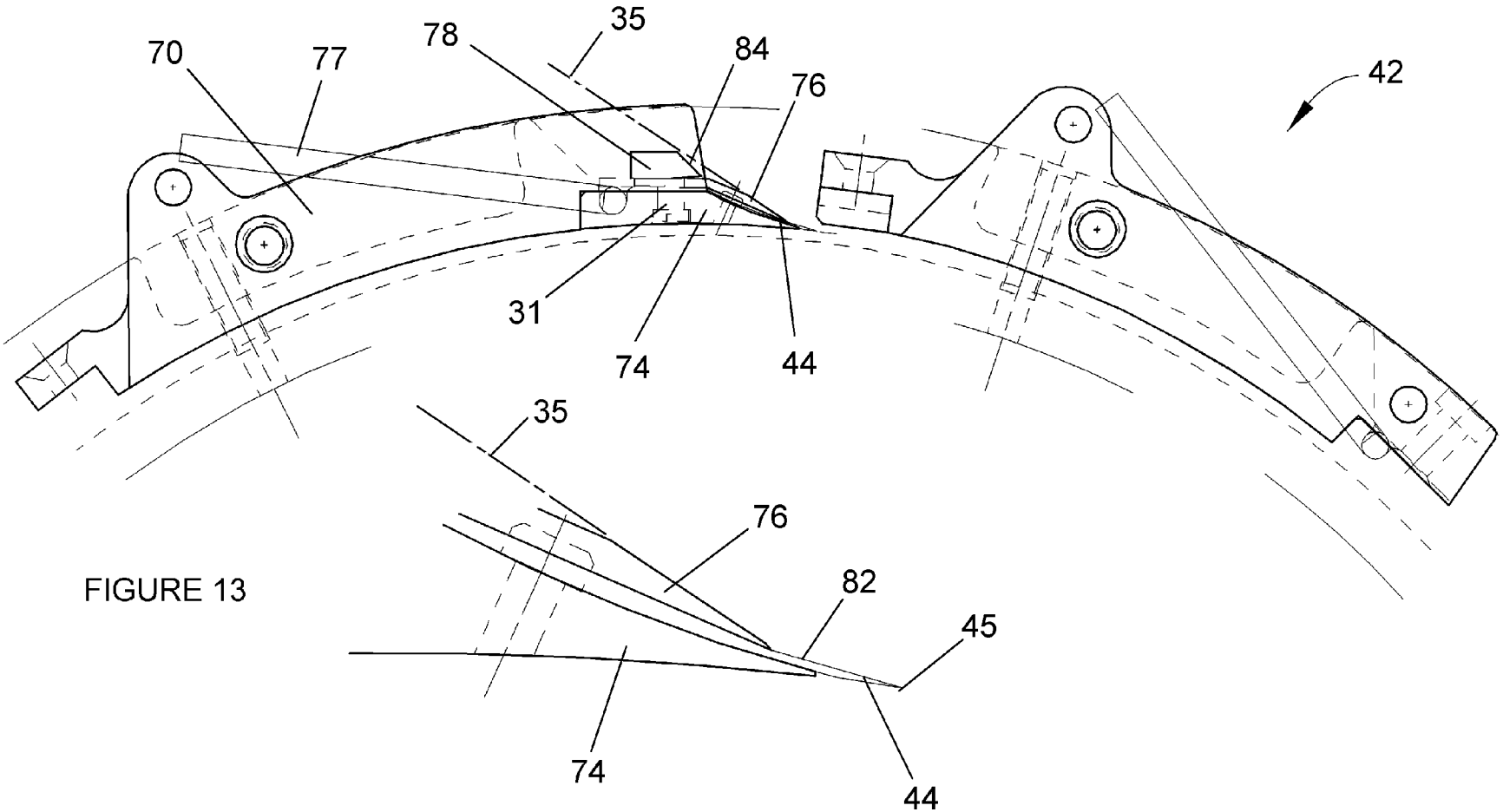

FIGS. 11, 12, and 13 are cross-sectional views showing portions of cutting heads 42 configured with different knife clamping hardware according to various embodiments of the invention. In each case, knives 44 are secured with a pair of holders 74 and 76, with the radially outer holder 76 being forcibly held in place on its support segment 70 with a clamping rod 78, essentially as described for FIG. 10. However, none of the knives 44 represented in FIGS. 11 through 13 are sheathed in a plastic cartridge as done in FIG. 10. The intent of omitting the plastic cartridge 30 of FIG. 10 is to more accurately locate the cutting edge 45 of each knife 44 relative to the axis of the cutting head 42 to achieve improved slice thickness accuracy and consistency. Specifically, the pliability of plastic materials renders the plastic cartridge 30 compressible, which reduces to some extent that accuracy with which the knife cutting edges 45 can be radially located with respect to the axis of the cutting head 42. Therefore, eliminating the cartridge 30 and forming the knife 44 and its holders 74 and 76 of substantially incompressible materials, such as metal, eliminates the dimensional changes that occur from compression under the clamping load of the rod 78, and ensures more accurate positioning of the knife cutting edges 45.

Figure 9:
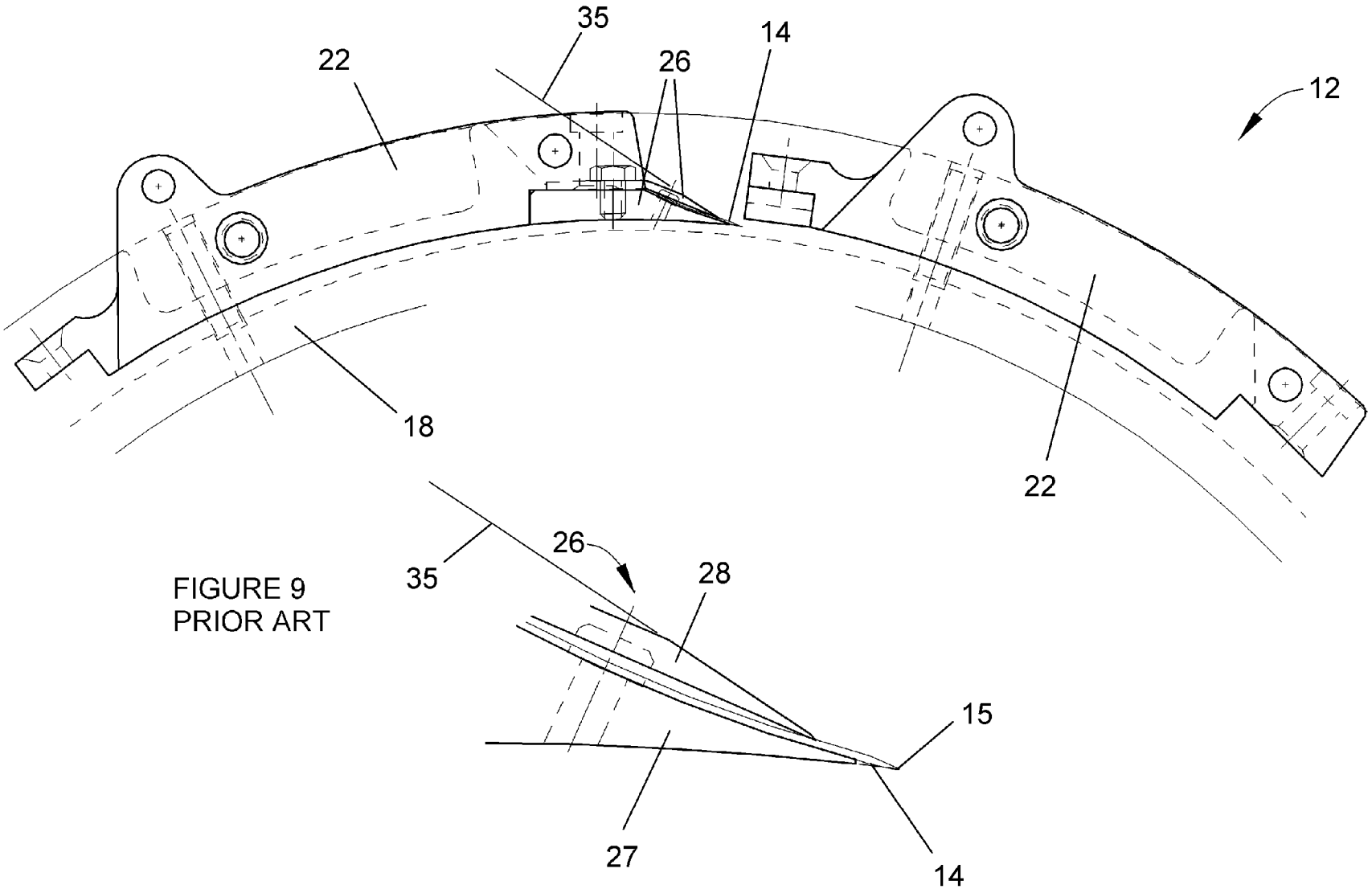
FIGURE 9 PRIOR ART
FIGS. 9 and 10 are cross-sectional views showing portions of existing cutting heads used with the Model CC® slicer.

In FIG. 11, a conventional double-beveled knife 44 is shown essentially similar to the knife 14 of FIG. 9. In practice, the trajectories 35 of slices traveling downstream from the knife 44 (as determined by the radially outer face 82 of the knife 44 and the radially outer holder 76) is such that slices are likely to hit the clamping rod 78. As a first solution, FIG. 12 shows the clamping rod 78 as having a half-round cross-section, which allows the clamping rod 78 to have a sufficiently lower profile that is radially inward from the trajectories 35 of slices exiting the knife 44. The knife 44 of FIG. 12 is also supported by an insert 80, such that the knife 44 is between the insert 80 and the inner holder 74. The insert 80 serves to protect the edge of the inner holder 74 from stones or other debris that are often unintentionally fed through the impeller assembly 40 along with food products.

In contrast to the knives 44 described thus far, the knife 44 shown in FIG. 13 is beveled only on its radially inner surface, which is opposite an unbeveled radially outer surface 82 of the knife 44. According to the present invention, a single-beveled knife edge 45 is believed to produce a cleaner slice and reduce the compression of food products during the slicing operation observed with the double-beveled knives 14 and 44 of FIGS. 9 through 12. However, as a result of lacking a bevel on its outer surface 82, the single-beveled knife 44 of FIG. 13 does not deflect slices to the extent that the double-beveled knives 14 and 44 of FIGS. 9 through 12 are capable. To avoid slices impacting the clamping rod 78, FIG. 13 shows the clamping rod 78 as generally having the form of a rectilinear bar with a tapered leading edge 84, resulting in the rod 78 having a sufficiently lower profile proximate to the knife 44 that is radially inward from the trajectories 35 of slices exiting the knife 44.

Figure 14:
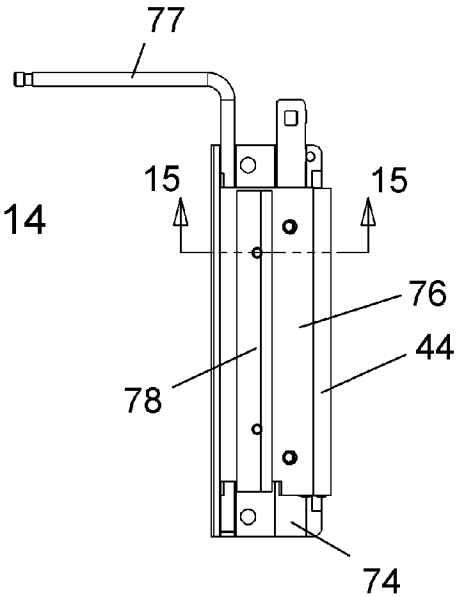
FIGS. 14 and 15 are side and cross-sectional views, respectively, of a clamping assembly shown in FIG. 13.
Figure 15:
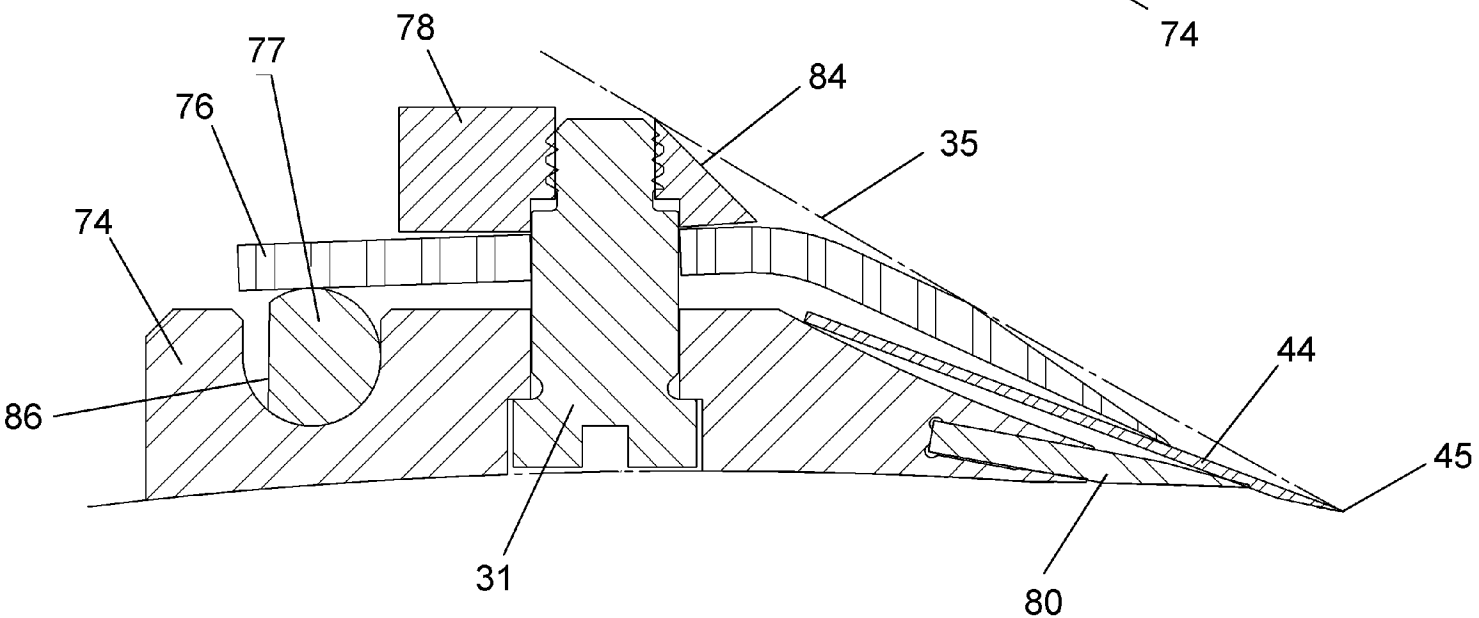

FIGS. 14 and 15 illustrate the clamping action performed by the clamping rod 78 in more detail. The embodiment shown in FIGS. 14 and 15 combine the insert 80 of FIG. 12 with the single-beveled knife 44 and tapered clamping rod 78 of FIG. 13. As evident from FIGS. 14 and 15, the lever 77 has forced one end of the outer holder 76 against the clamping rod 78, which in turn forces the opposite end of the outer holder 76 into engagement with the knife 44, forcing the knife 44 against the inner holder 74. The knife 44 can be released by rotating the lever 77 clockwise (as viewed in FIG. 15), such that a flat 86 on the lever 77 faces the outer holder 76, releasing the outer holder 76 from its engagement with the clamping rod 78.

While the invention has been described in terms of specific embodiments, it is apparent that other forms could be adopted by one skilled in the art. For example, the physical configurations of the impeller assembly 40, cutting head 42, and their components could differ from that shown, and materials and processes other than those noted could be use. Therefore, the scope of the invention is to be limited only by the following claims.

The invention claimed is:

1. A cutting apparatus comprising an annular-shaped cutting head and an impeller assembly coaxially mounted within the cutting head for rotation about an axis of the cutting head in a rotational direction relative to the cutting head, the impeller assembly having means for delivering food products radially outward toward the cutting head, the cutting head comprising:

at least one knife extending radially inward toward the impeller assembly in a direction opposite the rotational direction of the impeller assembly, the knife having a cutting edge at a radially innermost extremity thereof defined by oppositely-disposed radially inner and radially outer faces of the knife, one of the radially inner and radially outer faces of the knife being unbeveled at the cutting edge; and means for clamping the knife to the cutting head, the clamping means comprising an outer holding member contacting the radially outer face of the knife, an inner holding member contacting the radially inner face of the knife, a clamping member located adjacent a radially outermost extremity of the knife and oriented substantially parallel to the knife, means for securing the inner holding member and the clamping member to each other and retaining the outer holding member therebetween so as to allow radial movement of the outer holding member between the inner holding member and the clamping member, and means for forcing a first portion of the outer holding member radially outward into engagement with the clamping member to simultaneously cause a second portion of the outer holding member to move radially inward into engagement with the radially outer face of the knife to clamp the knife between the inner and outer holding members, the outer holding member and the radially outer face of the knife defining a trajectory plane for slices removed from the food products by the cutting edge, the clamping member having a tapered thickness in a radial direction of the cutting head that decreases in a direction toward the knife to provide clearance for the slices when traveling the trajectory plane of the knife;

wherein the forcing means forces the clamping member and the first portion of the outer holding member radially outward toward the trajectory plane of the knife.

2. The cutting apparatus according to claim 1, wherein the radially inner face is beveled at the cutting edge, and the radially outer face is not beveled at the cutting edge.

3. The cutting apparatus according to claim 1, wherein the forcing means comprises a rotatable lever having a flat, and the forcing means releases the outer holding member from engagement with the clamping member when the flat faces the outer holding member.

4. The cutting apparatus according to claim 1, wherein the securing means comprises at least one fastener that passes through the inner holding member, through the outer holding member and into the clamping member and allows for relative movement of the outer holding member between the inner holding member and the clamping member.

5. The cutting apparatus according to claim 1, wherein the clamping means further comprises a removable insert that defines a radially innermost extremity of the inner holding member, and the removable insert contacts the radially inner face of the knife adjacent the cutting edge thereof.

6. The cutting apparatus according to claim 1, wherein the clamping means does not compress a polymeric material when generating the clamping force with the clamping member.

7. The cutting apparatus according to claim 1, wherein the clamping means comprises only metallic materials.

8. A cutting apparatus comprising an annular-shaped cutting head and an impeller assembly coaxially mounted within the cutting head for rotation about an axis of the cutting head in a rotational direction relative to the cutting head, the impeller assembly having means for delivering food products radially outward toward the cutting head, the cutting head comprising:

at least one knife extending radially inward toward the impeller assembly in a direction opposite the rotational direction of the impeller assembly, the knife having a cutting edge at a radially innermost extremity thereof defined by oppositely-disposed radially inner and radially outer faces of the knife, wherein the radially inner face is beveled at the cutting edge and the radially outer face is not beveled at the cutting edge; and means for clamping the knife to the cutting head, the clamping means comprising an outer holding member contacting the radially outer face of the knife, an inner holding member contacting the radially inner face of the knife, a clamping member located adjacent a radially outermost extremity of the knife and oriented substantially parallel to the knife, means for securing the inner holding member and the clamping member to each other and retaining the outer holding member therebetween so as to allow radial movement of the outer holding member between the inner holding member and the clamping member, and means for forcing a first portion of the outer holding member radially outward into engagement with the clamping member to simultaneously cause a second portion of the outer holding member to move radially inward into engagement with the radially outer face of the knife to clamp the knife between the inner and outer holding members, the outer holding member and the radially outer face of the knife defining a trajectory plane for slices removed from the food products by the cutting edge, the clamping member having a tapered thickness in a radial direction of the cutting head that decreases in a direction toward the knife to provide clearance for the slices when traveling the trajectory plane of the knife;

wherein the forcing means forces the clamping member and the first portion of the outer holding member radially outward toward the trajectory plane of the knife.

9. The cutting apparatus according to claim 8, wherein the forcing means comprises a rotatable lever having a flat, and the forcing means releases the outer holding member from engagement with the clamping member when the flat faces the outer holding member.

10. The cutting apparatus according to claim 8, wherein the securing means comprises at least one fastener that passes through the inner holding member, through the outer holding member and into the clamping member and allows for relative movement of the outer holding member between the inner holding member and the clamping member.

11. The cutting apparatus according to claim 8, wherein the clamping means further comprises a removable insert that defines a radially innermost extremity of the inner holding member, and the removable insert contacts the radially inner face of the knife adjacent the cutting edge thereof.

* * * * *